US005489132A

United States Patent [19]

Schneider

[11] Patent Number: 5,489,132

[45] Date of Patent: Feb. 6, 1996

[54] SAFETY LATCH

[75] Inventor: William E. Schneider, White Pine, Tenn.

[73] Assignee: The United States of America as represented by the Secretary of the Navy, Washington, D.C.

[21] Appl. No.: 312,947

[22] Filed: Sep. 30, 1994

[51] Int. Cl.[6] ..... B65D 45/30

[52] U.S. Cl. ..... 292/256.75; 292/DIG. 65

[58] Field of Search ..... 292/92, DIG. 65, 292/256.71, 256.73, 256.75, DIG. 11

[56] References Cited

U.S. PATENT DOCUMENTS

| | | | |
|---|---|---|---|
| 922,508 | 5/1909 | Puffer | 292/256.75 |
| 1,234,133 | 7/1917 | Cole | 292/256.75 |
| 3,655,926 | 4/1972 | Meermans . | |
| 3,907,157 | 9/1975 | Beattie | 292/256.75 X |
| 4,825,027 | 4/1989 | Yoon . | |

FOREIGN PATENT DOCUMENTS

| | | | |
|---|---|---|---|
| 571631 | 9/1977 | U.S.S.R. | 292/256.75 |
| 1503327 | 3/1978 | United Kingdom | 292/DIG. 65 |

*Primary Examiner*—Rodney M. Lindsey
*Attorney, Agent, or Firm*—Charles D. Miller

[57] ABSTRACT

A safety latch for securing a cover on a machine integrating a safety switch with a latching swing bolt. The swing bolt for securing the cover pivots between a latched position and an unlatched position. The switch for energizing and de-energizing the machine is switchable between a closed position and an open position. An interlock flag must be moved to a predetermined position before the latch can be released. Moving the flag to the predetermined position causes the safety switch to open, de-energizing the machine. A portion of the swing bolt obstructs the interlock flag from closing the switch, thus preventing the machine from being energized when the cover is unlatched. The swing bolt is preferably threaded and a nut is provided to clamp the threaded swing bolt in the latched position and secure the cover. A shoulder of the interlock flag prevents the nut from being loosened unless the interlock flag is moved to the predetermined position in which the machine is de-energized.

11 Claims, 1 Drawing Sheet

SAFETY LATCH

This invention was made with Government support by the Naval Surface Warfare Center. The Government has certain rights in this invention.

BACKGROUND OF THE INVENTION

1. Field of the Invention

Machines used to pulp or grind cardboard, paper and food waste can be hazardous to human operators. Accordingly, such machines often include safeguards to protect operators from danger, such as covers which shield operators from unsafe exposure to moving parts. From time to time, the covered machine elements must be accessed, such as for routine cleaning and maintenance. As a result, latches are provided on the covers. To prevent injury, safety switches are provided with the latches to prevent operators from accessing the machine until conditions are safe.

2. Description of the Related Art

One type of existing safety latch mechanism currently in use on U.S. Navy machinery includes a switch which turns a machine's electric drive motor off when a cover is raised. This safety latch system includes one safety switch and two safety cover latches. The safety switch does not deactivate the machine until the cover latches are released and the cover of the machine is lifted. Typically, unless a braking mechanism is employed, the machine needs 10 to 15 seconds to come to a complete stop. As a result, the cover can be fully raised while the machine is still running, presenting the operator with a dangerous situation.

SUMMARY OF THE INVENTION

The present invention overcomes the above-noted problem and other problems associated with prior art safety latches. In contrast to the prior art, the latch of the present invention ensures complete stoppage of a machine before access is provided through an open cover.

Specifically, the safety latch of the present invention includes a bolt, a switch and an interlocking flag which cooperate to prevent the machine cover from being opened while the machine is operational. The bolt is movable between a latched position and an unlatched position to respectively secure and release the cover in place on the machine. The switch is switchable between a closed state and an open state to respectively energize and de-energize the machine. The interlock flag is movable in position to selectively place the switch in either the closed state or the open state, the interlock flag preventing movement of the bolt from the latched position to the unlatched position when the interlock flag is moved in position to place the switch in the closed state.

Advantageously, when the bolt is in the unlatched position, a portion of the bolt obstructs the interlock flag from closing the switch. Unless the bolt is in the latched position, the switch is inaccessible to the interlock flag, thus preventing the machine from being energized when the cover is unlatched.

The bolt is preferably a swing bolt held in the latched position by a clamp. The clamp is preferably a wing nut threaded onto the swing bolt. Advantageously, by using the wing nut to clamp the swing bolt, additional time is required to open the safety latch of the present invention (as compared to a standard quick-action latch), thereby providing sufficient time for machine elements to come to rest, and increasing operator safety. The threaded-nut method of clamping also advantageously provides for consequential adjustment of the clamping pressure. Slight variations in cover seating or seal compression will be accounted for each time the cover is clamped in place.

A further safety feature of the present invention is provided by the inclusion of a shoulder on the interlock flag which blocks rotation of the clamping wing nut when the interlock flag is moved in position to place the switch in the closed state. Specifically, the above-described wing nut impinges on the shoulder of the interlock flag, such that the interlock flag must be moved in order to allow the operator to loosen the clamp.

The switch is preferably either a proximitytype or plunger-type switch. A notch is preferably provided adjacent the switch, the interlock flag being alignable with and receivable within the notch to ensure that the cover is securely clamped by the bolt and wing nut before the switch is closed.

In the operation of the safety latch, when the operator requires access to machinery behind the cover, the interlock flag must be moved to free the swing bolt, which requires that the interlock flag be swung away from the switch, which in turn effects machine shutdown. With the interlock flag in the off position, the operator is free to loosen the wing nut, reposition the swing bolt, and open the cover.

Preferably, two or more latches will be used on each cover, with each latch having a safety switch. Any increase in cost attendant to such an arrangement is offset by the resultant increase in operator safety. By providing a safety switch in each latch, opening any one latch will de-energize the machine's drive motor before the other latches can begin to be opened. Using multiple latches further increases the time required to unlatch and open the safety cover, and thus increases operator safety.

Other features and advantages of the present invention will become apparent from the following description of the invention which refers to the accompanying drawings.

DETAILED DESCRIPTION OF THE PREFERRED EMBODIMENT

Figure 1:
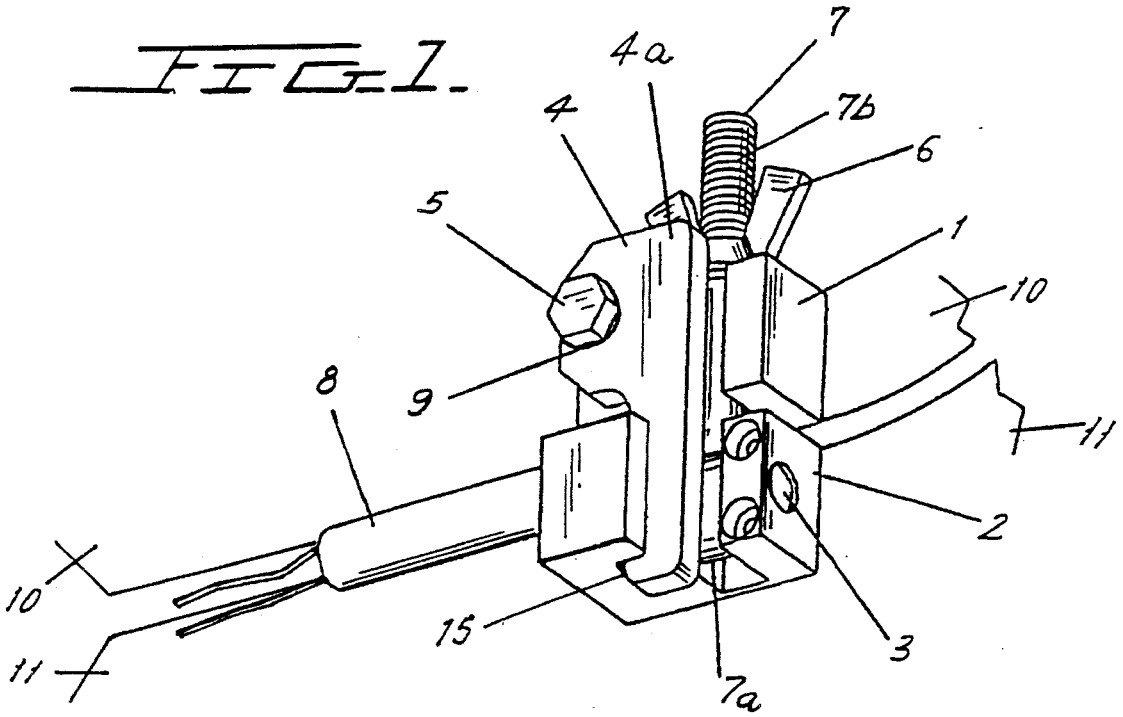
FIG. 1 is a perspective view of a portion of a machine and cover incorporating the latch, with the latch in the latched position.
Figure 2:
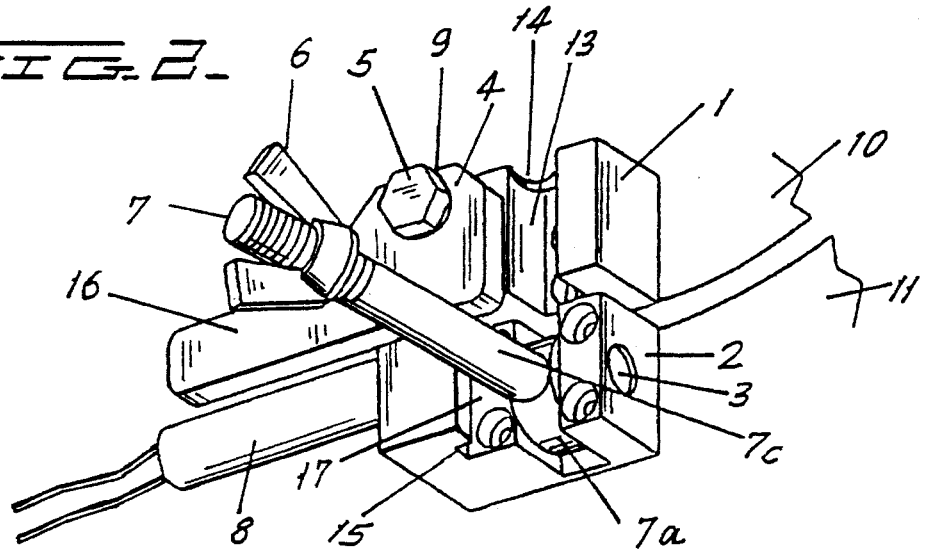
FIG. 2 is a perspective view of the portion of the machine and cover incorporating the latch, with the latch in the unlatched position.

Referring to FIGS. 1 and 2, the safety latch of the present invention is formed of two parts, upper block 1 and lower block 2, on which the various components are disposed. Upper block 1 is mounted to a machine safety cover 10, which can be opened or removed to access the machine. A safety interlock flag 4 is pivotably fixed to the upper block by a bolt 5. A spring-loaded washer 9 is preferably provided under the head of bolt 5 to frictionally restrict rotation of the interlock flag around its pivot point.

Lower block 2 is secured to a fixed portion 11 of the machine. A proximity switch 8 of a known type for energizing or de-energizing the machine is attached to lower block 2. Switch 8 is closed and the machine is energized when the interlock flag 4 is pivoted to the position shown in FIG. 1. As shown schematically in FIG. 2, a detent 16, preferably provided on the back of interlock flag 4, is adapted to slide over a corresponding protrusion 17 or spring-loaded ball in lower block 2 to secure interlock flag 4 in the latched position shown in FIG. 1.

A swing bolt 7, for securing cover 10 to fixed portion 11 of the machine, is mounted on lower block 2. Swing bolt 7 has an eye 7*a* at its base through which a pin 3 extends, such that swing bolt 7 is pivotable from the latched position shown in FIG. 1 to the unlatched position shown in FIG. 2.

When cover 10 is latched closed as shown in FIG. 1, swing bolt 7 is received in a groove 13 in the upper block 1. Swing bolt 7 preferably includes a threaded portion 7*b* for receiving a wing nut 6. When wing nut 6 is tightened onto a threaded portion 7*b* of swing bolt 7, cover 10 is securely clamped onto fixed portion 11 of the machine. Likewise, when wing nut 6 is unscrewed a sufficient amount, swing bolt 7 is released, such that it is free to pivot downward to the position shown in FIG. 2 in which cover 10 is unlatched and can be removed.

Optionally, a tapered counterbore 14 for receiving wing nut 6 can be formed in upper block 1. When wing nut 6 is fully seated in counterbore 14, an operator must turn the wing nut a certain number of additional times to release the swing bolt, hence increasing the amount of time required to release the latch, and further increasing operator safety.

As shown in FIG. 2, when cover 10 is unsecured, swing bolt 7, in particular shaft 7*c* thereof, prevents interlock flag 4 from rotating sufficiently in a clockwise direction to activate switch 8. Eye 7*a* of bolt 7 is appropriately machined to prevent downward rotation of swing bolt 7 beyond the blocking orientation shown in FIG. 2. In this regard, eye 7*a* may be provided with a projection (not shown) which engages lower block 2 when the swing bolt is in the unlatched position shown in FIG. 2.

Lower block 2 preferably includes a notch 15 (see FIG. 2) for receiving a leading edge of interlock flag 4 when the safety switch is in the closed position shown in FIG. 1. The leading edge of interlock flag 4 is not aligned with and cannot be received in notch 15 (and the safety switch can therefore not be closed) unless cover 10 is securely clamped to fixed portion 11 of the machine. Thus, the cover must be secured before the machine can be energized. The notch also physically protects the switch from inadvertent damage and complicates any potential sabotage of the safety latch.

As a further safety feature, when the interlock flag is in the switch-energizing position, rotation of wing nut 6 is prevented by a shoulder 4*a* of the interlock flag, as shown most clearly in FIG. 1. Thus, an operator cannot even begin to release the clamped swing bolt 7 while the machine is energized.

Figure 3:
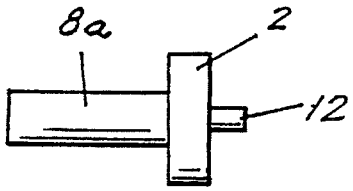
FIG. 3 is a detail view of an alternative plunger-action switch for use in the latch of the present invention.

In an alternative embodiment of the invention, the safety switch is a plunger-type switch 8*a* as shown in detail in FIG. 3. In this embodiment, interlock flag 4 depresses button 12 to energize the machine when the safety latch is in the closed position shown in FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A latch for securing a cover on a machine, the latch comprising:

a bolt movable between a latched position and an unlatched position, the bolt securing the cover in place on the machine when the bolt is in the latched position;

a switch switchable between a closed state and an open state for respectively energizing and de-energizing the machine; and an interlock flag, movable in position to selectively place the switch in either the closed state or the open state, the interlock flag preventing movement of the bolt from the latched position to the unlatched position when the interlock flag is moved in position to place the switch in the closed state.

2. The latch of claim 1, wherein the bolt is mounted on one of the cover and the machine for pivoting between the latched and unlatched positions.

3. The latch of claim 1, wherein a portion of the bolt obstructs the interlock flag from placing the switch in the closed state unless the bolt is in the latched position.

4. The latch of claim 1, further comprising a clamp for securing the bolt in the latched position.

5. The latch of claim 4, wherein the bolt is threaded and the clamp for securing the bolt in the latched position comprises a nut threadably engagable on the threaded bolt.

6. The latch of claim 5, wherein the interlock flag includes a shoulder which obstructs rotation of the nut when the interlock flag is moved in position to place the switch in the closed state.

7. The latch of claim 1, wherein the switch is a proximity-sensing switch which is placed in the closed state when the interlock flag is moved to a position in proximity therewith.

8. The latch of claim 1, wherein the switch is a plunger-type switch which is placed in the closed state when the interlock flag is moved to engage a plunger on the plunger-type switch.

9. The latch of claim 1, wherein a notch is provided adjacent the switch, the interlock flag being alignable with and receivable within the notch to place the switch in the closed state when the cover is secured in place on the machine.

10. The latch of claim 1, wherein the interlock flag further comprises a detent for engaging a corresponding protrusion to frictionally retain the interlock flag in position to place the switch in the closed state.

11. A safety latch for securing an access cover on a machine for grinding waste, the safety latch comprising:

an upper block mounted on the access cover;

a lower block mounted on the machine;

a threaded bolt rotatably secured to the lower block by a pin, the bolt being rotatable between a latched position and an unlatched position, the bolt securing the cover in place on the machine when the bolt is in the latched position;

a wing nut threadably engagable on the threaded bolt for securing the bolt in the latched position;

a switch mounted on the lower block and switchable between a closed state and an open state for respectively energizing and de-energizing the machine; and an interlock flag rotatably mounted on the upper block by a second bolt, a spring-loaded washer being provided between the second bolt and the interlock flag for frictionally restricting rotation of the interlock flag, the interlock flag being movable in position to selectively place the switch in either the closed state or the open state, the interlock flag preventing movement of the bolt from the latched position to the unlatched position when the interlock flag is moved in position to place the switch in the closed state, the interlock flag including a shoulder which obstructs rotation of the wing nut when the interlock flag is in position to place the switch in the closed state.

* * * * *